US010265874B1

(12) United States Patent
Morgan

(10) Patent No.: US 10,265,874 B1
(45) Date of Patent: Apr. 23, 2019

(54) MULTI-FUNCTIONAL VEHICLE ESCAPE DEVICE

(71) Applicant: Jesse P Morgan, Fort Myers, FL (US)

(72) Inventor: Jesse P Morgan, Fort Myers, FL (US)

( * ) Notice: Subject to any disclaimer, the term of this patent is extended or adjusted under 35 U.S.C. 154(b) by 22 days.

(21) Appl. No.: 15/330,530

(22) Filed: Oct. 3, 2016

Related U.S. Application Data

(60) Provisional application No. 62/284,599, filed on Oct. 5, 2015.

(51) Int. Cl.
*B26B 11/00* (2006.01)
*B26B 3/00* (2006.01)
*B26B 3/08* (2006.01)

(52) U.S. Cl.
CPC ..... *B26B 11/006* (2013.01); *B26B 3/00* (2013.01); *B26B 3/08* (2013.01); *B26B 11/00* (2013.01)

(58) Field of Classification Search
CPC .. B62B 1/00; B62B 5/00; B62B 1/044; B26B 1/044; B26B 3/00; B26B 11/00; B26B 11/003; B26B 11/006; B26B 3/08
See application file for complete search history.

(56) References Cited

U.S. PATENT DOCUMENTS 5,097,599 A 3/1992 Hasegawa
5,251,351 A * 10/1993 Klotz ..... A47L 1/08 15/105
5,437,102 A * 8/1995 Fox ..... B26B 3/04 30/298.4
5,630,242 A 5/1997 Oginaezawa
5,903,942 A 5/1999 Hasegawa
6,418,628 B1 7/2002 Steingass
6,453,564 B1 9/2002 Foley
7,028,847 B2 4/2006 Lin
7,051,391 B2 5/2006 Wang
D577,562 S 9/2008 Lin
D642,444 S * 8/2011 Kommer ..... D8/105
8,015,643 B2 9/2011 White
D694,609 S 12/2013 Hicks
D705,682 S 5/2014 Stowers
D715,124 S 10/2014 Hicks
D744,807 S 1/2015 Hicks
D724,408 S 3/2015 Hicks
D728,338 S 5/2015 Hicks
D738,669 S 9/2015 Hicks
9,179,762 B2 10/2015 Hanover
9,254,560 B2 * 2/2016 Rubin ..... B25F 1/006
9,265,976 B1 2/2016 Hensley
D751,881 S 3/2016 Hicks
9,815,212 B2 * 11/2017 Barr ..... B26B 1/044
(Continued)

FOREIGN PATENT DOCUMENTS

JP 2007137312 A * 6/2007 ..... B60R 21/00

*Primary Examiner* — Faye M Fleming
(74) *Attorney, Agent, or Firm* — George Divincenzo

(57) ABSTRACT

The present invention discloses a vehicular emergency device wherein the driver or passenger's are unable to escape from the vehicle due to damage from the accident. The device consists of a hand-held tool that is equipped with a removable clip, an economic handgrip, a seat belt cutter, a tungsten carbide coated steel probe that is used to shatter automotive glass with a single stroke. The device disclosed herein is made of high density molded plastic that will withstand pressures likely to be encountered in an emergency situation.

12 Claims, 5 Drawing Sheets

(56) References Cited

U.S. PATENT DOCUMENTS

| | | | | |
|---|---|---|---|---|
| 2015/0033477 | A1 | 2/2015 | Rubin | |
| 2016/0038773 | A1 | 2/2016 | Sun | |
| 2016/0193737 | A1* | 7/2016 | Barr | B26B 1/044 132/143 |

* cited by examiner

10

10

12

MULTI-FUNCTIONAL VEHICLE ESCAPE DEVICE

STATEMENT REGARDING FEDERALLY SPONSORED RESEARCH OR DEVELOPMENT

This invention was made without government support.

BACKGROUND OF THE INVENTION

1. Field of the Invention

The present invention relates motor vehicles and to the use of a multi-functional vehicle crash survival device to aid trapped occupants within a vehicle to escape from the vehicle during an emergency.

2. Description of the Related Art

The related art discloses a number of inventions that deal with an automotive emergency devices for use by one who is tapped in a vehicle due to an accident. Several devices are disclosed that will enable one to either cut an inoperable seat belt and/or to break a window within the automobile when the door is nonfunctional thereby to provide a means of egress.

Motorized vehicles can encounter many emergency situations in which it is necessary to escape from the vehicle involved in an accident with another vehicle, or with another object such as an abutment or stationary object such a tree or may become overturned and in rare occasions may catch fire or leave the roadway and become submerged. In the situation of an overturned vehicle in which the occupants are strapped into their vehicle by their seat belts, they are frequently unable to release the seat belt in order to escape from the vehicle. In such emergencies, it may be necessary to quickly cut the seat belt strap and or to break a closed window in order to escape from the damaged, overturned or submerged vehicle. In the aftermath of such an accident, the doors and windows are frequently jammed or damaged due to the accident and may be inoperative. Also in such an emergency situations, seat belts are often under tension which may render a seat belt buckle release mechanism to be inoperative. During such situations, the vehicle occupants are usually under extreme stress and thus may lack the ability or the physical strength to free themselves from the vehicle in the absence of outside help. Accordingly, in these situations what is needed is a readily available hand held device which is safe to use and can be easily and quickly procured by the vehicle driver to perform the task of cutting the seat belt strap and if necessary, to break a closed vehicle window as a means to escape from the vehicle.

The need for an easy to use and functional vehicular escape device is apparent by the number of patents that have been issued for a variety of different product designs. Many of these inventions, some of which are summarized below, have a common element, .ie., a device which can be used to cut through a seat belt that is no longer operable or to exit a vehicle in which the doors are no longer operable or in the extreme case when a car is submerged in a body of water or catches fire. The following inventions listed below show a variety of different attempts to meet this need.

from a car when an accident happens. This invention comprises a scissors for cutting a seat belt and a spike that protrudes from the handle of the scissors the tip of which is pressed against the window glass. A spike driver is housed in the handle and when the spike is pressed against the window, it is displaced inwardly and is then is released to strike the glass of the window.

U.S. Pat. No. 5,097,599 discloses a seat belt cutter used in automotive vehicles that includes a blade and hammer member which are provided on a grip member. The blade member has an serrated edge and is pivotally mounted on the grip member. The hammer can include a pair of sharply pointed heads at portions or a single hammer member and the hammer is provided at the end of the grip member.

U.S. Pat. No. 5,630,242 discloses a seat belt cutter comprising an upper surface member, a lower surface member which is longer than the upper surface member, a gripping handle member of blade member, having a serrated edge portion and a hammer member. This device is used to cut a seat belt and also to strike the window glass with a hammer member.

U.S. Pat. No. 6,418,628 B1 discloses a spring-loaded car window breaker and a slot cutter for cutting seat belts that is small enough to carry on a key chain, pocket, purse, or in automobile glove compartment. The window braking element is cocked and fired in one motion. Fully cocking this device all the way causes a hammer to be released so that impacts the window glass thereby breaking the window.

U.S. Pat. No. 6,453,564 B1 discloses a multi-function rescue tool comprising a handle body, a serrated blade that is pivotally coupled to the handle body, a spring-loaded punch to fracture the glass in a window of a vehicle and a hooked blade that can be used to cut a seat belt.

U.S. Pat. No. 7,028,874 B2 discloses a window breaking emergency escape device that comprises a main body, a hammer and a supplementary power apparatus wherein the hammer and the supplementary power apparatus are installed in the main body. The front end of the hammer extrude from the surface of the main body. The supplementary power apparatus reserve has enough power in advance to lessen the operating force and releases the reserve power to drive the hammer to break the car window if needed when an accident happens. Moreover, the main body of the device of the present invention includes a hook containing a cutter to cut the seat belt if necessary.

U.S. Pat. No. 7,051,391 B2 discloses an emergency escape tool for helping people escape from a vehicle in an emergency consisting of a main member containing a hammer, a cutting device at the opposite ends thereof, a whistle, and a light emitting device. A clip and a holder are mounted on the main member to fasten the main member on the seat belt of the vehicle.

U.S. Pat. No. D577,562 S discloses a vehicular survival tool that contains a hammer member and a cutting member that will enable the occupant of the vehicle to escape the vehicle if it is needed.

U.S. Pat. No. 8,015,643 B2 discloses a vehicle escape tool having a generally symmetrical body including a handle portion and a cutting portion. The handle portion carries two opposite window breaking elements adapted for breaking and shattering tempered motor vehicle window glass. The cutting portion includes opposite cutters having fingers with defined slots for receiving the seat belt webbing material. The cutting slots lead to sharp blades fixed at the closed end of each slot. The body includes at least one compartment for carrying an emergency item such as a fire starting flare or an emergency locating transmitter. The body is also equipped with two clips for attaching the device to a window visor or some other object.

U.S. Pat. No. D694,699 S discloses the design of a rescue tool that contains a lighting device at one end, and a window shattering device at the other end, a cutting blade, and a main linear body on which to hold the device.

U.S. Pat. No. D705,682 S discloses the design of an automobile safety device comprising a window braking device, and a sea seat belt cutter.

U.S. Pat. No. D715,124 discloses the design of a rescue tool comprising a pen shaped device containing a seat belt cutter and a probe to be used to break window glass.

US Patent Application No. 2015/0033477 A1 discloses an ergonomic auto emergency tool for alternatively functioning as a flashlight, a seat belt cutter and a motor vehicle window glass breaker. The auto emergency tool includes a main portion and a projecting portion extending from a joining portion and being integral to the main portion and defining a seat belt receiving notch there-between. A knife blade extends across a notch proximate to the joining portion. The window breaking mechanism includes a depressible civil plunger cover for releasing a spring-loaded impact member.

U.S. Pat. No. D724,408 S discloses the design of a rescue tool that contains a seat belt cutting element and the window glass probe joined by a intermediate grip area.

US Pat. No. D728,338 S discloses a design of a rescue tool comprising a seat belt cutting portion and a window breaking portion.

U.S. Pat. No. D738,699 S discloses a design of a rescue tool comprising a seat belt cutting portion and a window breaking portion.

U.S. Pat. No. 9,179,726 B2 discloses a wearable utility instrument assembly including a headgear and at least one utility instrument. The utility instrument is shaped and sized to be securely retained and concealed within the brim portion of the headgear. The utility member contains a window braking portion and a seat belt cutting portion.

U.S. Pat. No. D744,807 S discloses the design of a rescue tool which has a seat belt portion and a window breaking portion.

U.S. Pat. No. 9,254,560 B2 discloses an ergonomic auto emergency tool for alternatively functioning as a flashlight, an illuminating distress signal, a sonic alarm, a tire depth gauge, a tire air pressure gauge, a seat belt cutter and a motor vehicle window glass breaker. The window braking mechanism includes a compressible plunger cover for releasing a spring-loaded impact member. An optional visor clip is also provided for storing the tool on the visor of a motor vehicle.

US Patent Application No. 2016/0038773 A1 discloses a multi-functional car power receptacle having a life-saving tool that includes a handle for providing a receptacle and a function head connected to the front end of the handle. The functional head comprises a glass smasher and a power plug. The function head and the front end of the handle are connected through a rotation shaft, enabling the function head to pivot about the rotation shaft for changing an end of the functional head to be used. The power plug is electrically connected with the handle through electric wires of the rotation shaft. The function head of the present invention combines the glass smasher with the power plug. The present invention is provided with the seat belt cutter for the driver to cut the seat belt in an emergency. The handle is provided with a magnet and a warning light.

U.S. Pat. No. D751,881 S discloses the design of a rescue tool comprising a seat belt cutter, a shaft and a window breaking element.

U.S. Pat. No. 9,265,976 B1 discloses a multipurpose automobile device comprising a shaft, where attached to that shaft is a hammer means for use in breaking out the window of an automobile in an emergency, a seat belt cutting means for cutting the seat belt of an automobile when the seat belt buckle cannot be released or reached, and a seat belt treading means for treading seat belt of an automobile through a child safety seat. The multipurpose automobile device may also comprise an ice scraping means, a brush means, or both additional tools.

BRIEF SUMMARY OF THE INVENTION

The present invention discloses a hand held multi-use device, referred to herein as the Extractor, that can be attached to the visor in a vehicle by an removable clip so that it is readily available to the driver in a vehicle related accident or emergency. The Extractor has a number of utilities, foremost it can be used as a seat belt cutter and is also equipped with a tungsten carbide tip that can be used to break automotive window glass. Tungsten carbide is considered to be one of the hardest metals available with a hardness that is similar to that of diamonds and is very efficacious in breaking automotive window glass with a single strike provided the tungsten carbide content is high enough. The tungsten carbide content of the present invention is equal to or greater than 16% and this enables the glass to be shattered with a single strike. The device of the present invention also has a plurality of hex head openings ranging from 0.635 cm to 1.27 cm (¼ to ½ inch) sizes to loosen or remove hex head bolts within the vehicle. The Extractor is also equipped with a scraper to remove ice or dirt or other objects adhering on the surface of window glass and is also scored as a ruler as a convenience to the occupant. The Extractor is light in weight and is made of high density molded ABS plastic that is very durable and is ergonomically designed to fit comfortably in one's hand. This device is both useful and pragmatically designed to address a number of non emergency needs, but foremost is intended to be used as an emergency automotive escape device. Alternative uses of the Extractor include its ability to cut rope, cut wire, cut bun-gee cord, strip wire, cut fishing line, break a block of ice, and open letters and use as a ruler.

In another embodiment, the Extractor may be equipped with a spring activated mechanism to propel the tungsten carbide probe into the window glass to shatter the window so that occupants have a means to escape from the vehicle.

The use of a removable window visor clip enables one to remove the detachable visor clip and store the Extractor efficiently in a purse, bag or storage compartment within the vehicle. It is desirable, however, to store the Extractor on the window visor so that it is readily available for use in an emergency.

The objective of the present invention is to provide an improved versatile multi-purposed hand held device or tool that is primarily intended to be used as an emergency escape device within a vehicle that enables the driver or passengers within the vehicle to escape from the vehicle during an emergency wherein the doors are damaged and are no longer usable as a means to exit the vehicle and/or when the seat belts are inoperative due to the accident and are unable to be released manually. The multi-use vehicle escape device disclosed herein has a number of features that include a built-in razor or blade for cutting a seat belt if trapped in a situation with the belt cannot be manually released, a built-in tungsten carbide probe that has sufficient tungsten carbide content to break automotive window glass with a single stroke, if needed, a scraper edge to remove debris from the window glass or wind shield, a ruler, several hex head openings incorporated into the device to remove hex head bolts, and a detachable clip that conveniently attaches the device to car visor or the detachable clip can be removed and stored in a glove compartment or purse. The multi-purposed device is light in weight, is durable and is rigid to withstand the forces needed to escape from a vehicle that has been damaged due to an accident.

DETAILED DESCRIPTION OF THE INVENTION

The present invention provides an improved multi-functional emergency escape device to be used in a vehicular emergency that enables driver or the passengers within the vehicle to escape from the vehicle when the doors are damaged and not operable and/or the seat belt is inoperable due to damage incurred from the accident. The multi-use survival device has a number of features that are not present in prior inventions designed to be used in a vehicular emergency. The specifics of the present invention are disclosed below.

Figure 1:
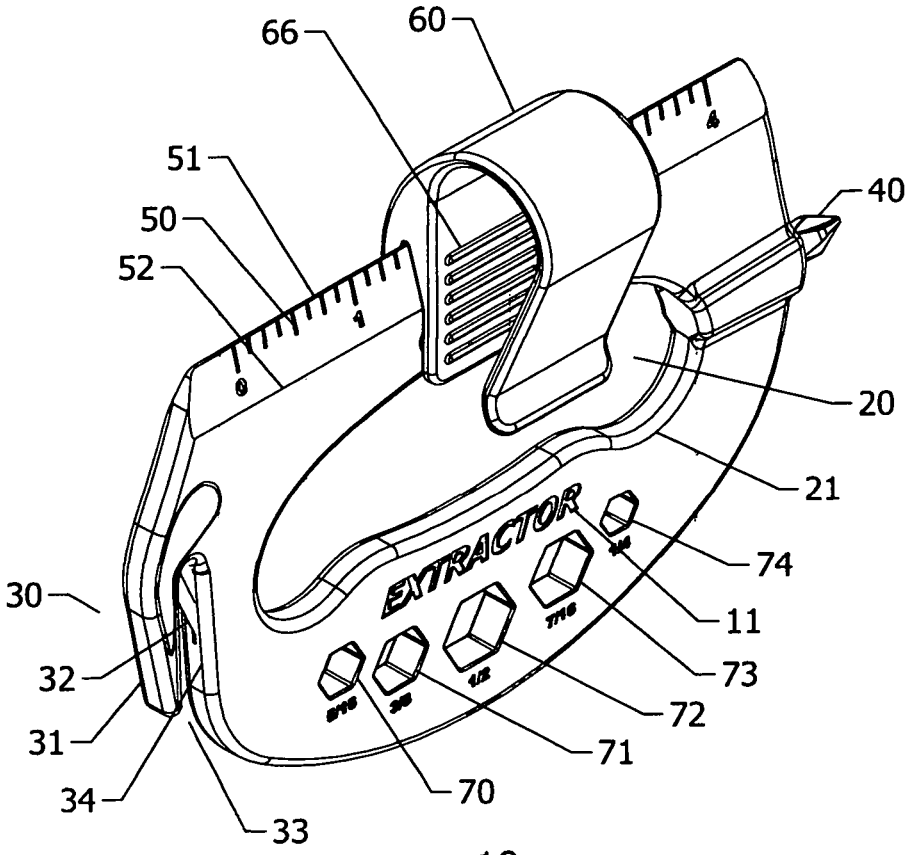
FIG. 1 discloses a perspective front and left side view of the multi-functional hand held emergency escape device that will enable the occupants of a vehicle involved in an accident to escape from the vehicle.

FIG. 1 shows a perspective view of the of the multi-functional emergency vehicle escape device (10) showing the front and left side views, respectively. Device (10) is made of a light weight, yet durable, ABS plastic that is injection molded to form an ergonomic designed hand held device. ABS plastic has characteristics of strength and resistance to damage from impacts and is ideally suited for device (10). Device (10) is strong enough to withstand the forces typically involved in emergency use situations. It is very rigid and can withstand the pressures encountered in attempting to cut a seat belt or smash an automotive glass window. This also applies to windows that are coded with a window darkening substance or a coated film. The name of the emergency escape device is termed the Extractor (11) since its primary use is to escape from a damaged vehicle. Device (10) is designed to be hand held and incorporates an opening in the structure for one's hand to be inserted (20). The ergonomic hand grip (21) is designed to enable one to efficiently grip device (10) and hold it firmly within one's hand. The seat belt cutter (30) located on the left side device (10) and consist of an exterior portion of the blade holder (31), a sharp blade (32), a blade slot (33) in which blade (32) is inserted, and an interior portion of blade holder (34). On the right side of device (10) is the automotive window breaking apparatus consisting of a tungsten carbide tipped steel probe (40) that is designed to shatter automotive window glass with a single strike. This is primarily due to the use of a tungsten carbide tip which is at least made of 16% tungsten carbide. Tungsten carbide is considered one of the hardest metals available for commercial use. It is nearly as hard as diamond on the scale of hardness. The tungsten carbide content can be increased beyond 16% to enhance further the efficacy of the tungsten carbide probe (40). During the manufacture of device (10), the tungsten carbide steel probe (40) is inserted in a channel located on the right side of device (10). Probe (40) is held in position by compression fitting. Channel (41) not shown herein is drilled to be slightly smaller than the diameter of the tungsten carbide probe (40) and held securely in device (10). The top portion of the device (10) contains a ruler (50) containing a top edge (51) which can be used as a scraper to remove debris from the windshield. It also be used as a scraper ice. The bottom edge of ruler (50) protrudes a few millimeters from top edge (51) to help remove debris from device (10) while being used as a scraper by diverting the debris away from device (10). Slightly below bottom edge of ruler (50) is an indentation or depression (53) in the body of device (10) to attach a removable clip (60). Indentation (53) in a different embodiment can actually be a opening in which to receive removable clip (60). The interior surface of removable clip (60) has several elevated projections to firmly hold device (10) in position on the window visor. Device (10) is also equipped with hex head fittings (70, 71, 72, 73, 74) ranging in a variety of sizes from 0.7942 to 1.27 cm. Device (10) can also be used as a tool to either secure or remove hex head bolts.

Figure 2:
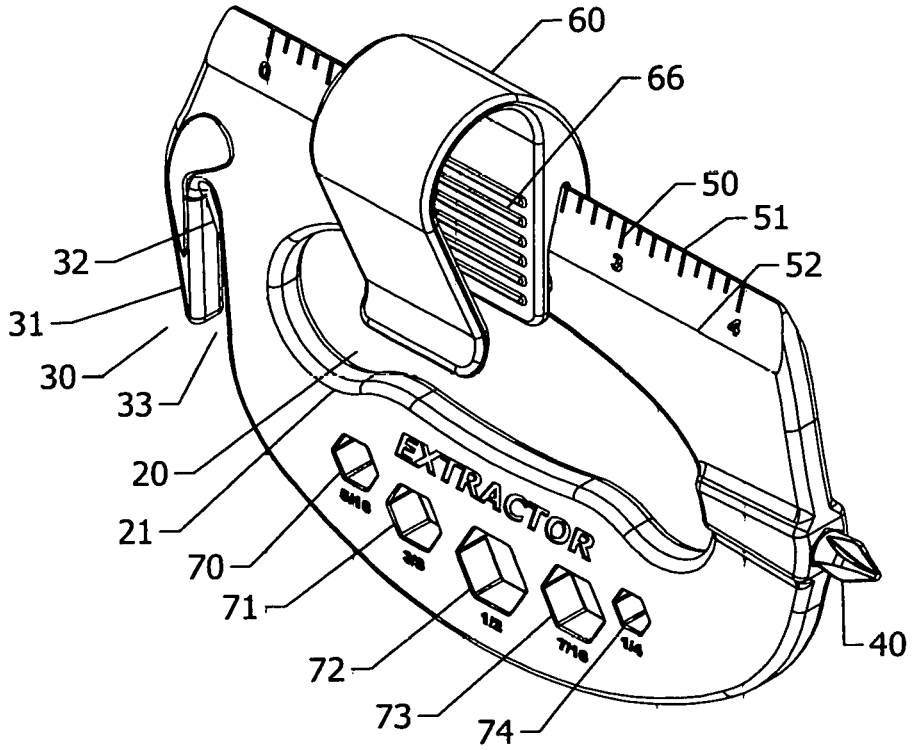
FIG. 2 discloses a perspective front and right side view of the multi-functional hand held emergency escape device.

FIG. 2 is a perspective view of the front and right side of the multi-functional emergency vehicle escape device (10) showing the front and left side views, respectively. Device (10) is injection molded to form an ergonomic designed hand held device. Device (10) is strong enough to withstand the forces typically involved in emergency use situations. The name of the emergency escape device is the Extractor (11) since its primary use is to escape from a damaged vehicle. Device (10) is designed to be hand held and incorporates an opening in the structure for one's hand to be inserted (20). The ergonomic hand grip (21) is designed to enable one to efficiently grip device (10) and hold it firmly within one's hand. The seat belt cutter (30) located on the left side of device (10) and consist of an exterior portion of the blade holder (31), a sharp blade (32), a blade slot (33) in which blade (32) is inserted, and an interior portion of bladed holder (34). On the right side of device (10) is a tungsten carbide tipped steel probe (40) that is designed to shatter automotive window glass with a single strike. This is primarily due to the use of a tungsten carbide tip which is at least made of 16% tungsten carbide. The tungsten carbide content can be increased beyond 16% to enhance further the efficacy of the tungsten carbide probe (40). During the manufacture of device (10), the tungsten carbide steel probe (40) is inserted in a channel located on the right side of device (10). Probe (40) is held in position by compression fitting. Channel (41) not shown herein is drilled to be slightly smaller than the diameter of the tungsten carbide probe (40) and held securely in device (10). The top portion of the device (10) contains a ruler (50) containing a top edge (51) which can be used as a scraper to remove debris from the windshield. The bottom edge of ruler (50) protrudes a few millimeters from top edge (51) to help remove debris from device (10). Slightly below bottom edge of ruler (50) is an indentation or depression (53) in the body of device (10) to attach a removable clip (60). Indentation (53) in a different embodiment can actually be a opening in which to receive removable clip (60). The interior surface of removable clip (60) has several elevated projections to firmly hold device (10) in position on the window visor. Device (10) is also equipped with hex head fittings (70, 71, 72, 73, 74)

ranging in a variety of sizes from 0.7942 to 1.27 cm. Device (10) can also be used as a tool to either secure or remove hex head bolts.

Figure 3:
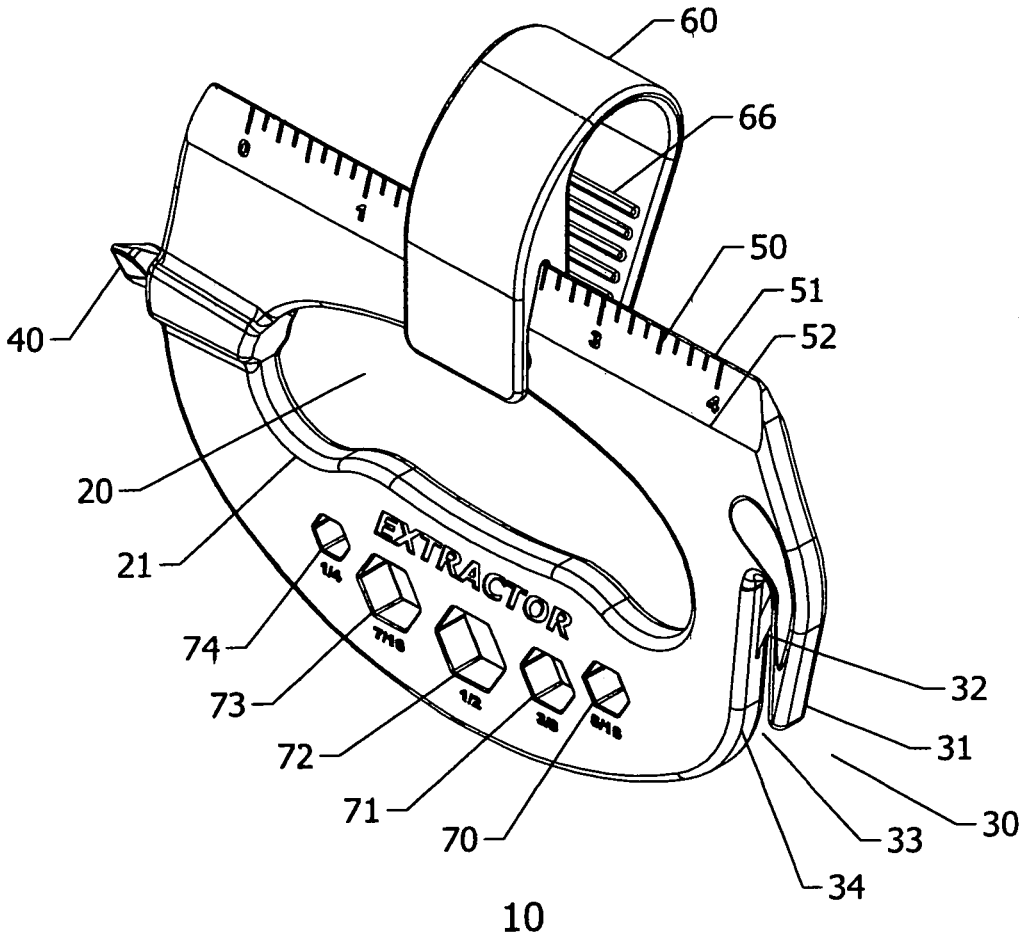
FIG. 3 discloses the rear view of the multi-functional hand held emergency escape device.

FIG. 3 shows the rear view of the multi-functional emergency vehicle escape device (10). Device (10) consists of an opening in the structure for one's hand to be inserted (20), an ergonomic hand grip (21), a seat belt cutter (30) located on the left side device (10) and consist of an exterior portion of the blade holder (31), a sharp blade (32), a blade slot (33) in which blade (32) is inserted, and an interior portion of bladed holder (34). On the right side of device (10) is the automotive window breaking apparatus consisting of a tungsten carbide tipped steel probe (40) that is designed to shatter automotive window glass with a single strike. This is primarily due to the use of a tungsten carbide tip which is at least made of 16% tungsten carbide. The tungsten carbide content can be increased beyond 16% to enhance further the efficacy of the tungsten carbide probe (40). During the manufacture of device (10), the tungsten carbide steel probe (40) is inserted in a channel located on the right side of device (10). Probe (40) is held in position by compression fitting. Channel (41) not shown herein is drilled to be slightly smaller than the diameter of the tungsten carbide probe (40) and is held securely in device (10). The top portion of the device (10) contains a ruler (50) containing a top edge (51) which can be used as a scraper to remove debris from the windshield. The bottom edge of ruler (50) protrudes a few millimeters from top edge (51) to help remove debris from device (10) while being used as a scraper by diverting the debris away from device (10). Below bottom edge of ruler (50) is an indentation or depression (53) in the body of device (10) to attach a removable clip (60). Indentation (53) in a different embodiment can actually be a opening in which to receive removable clip (60). Device (10) is also equipped with hex head fittings (70, 71, 72, 73, 74) ranging in a variety of sizes from 0.7942 to 1.27 cm. Device (10) can also be used as a tool to either secure or remove hex head bolts.

Figure 4:
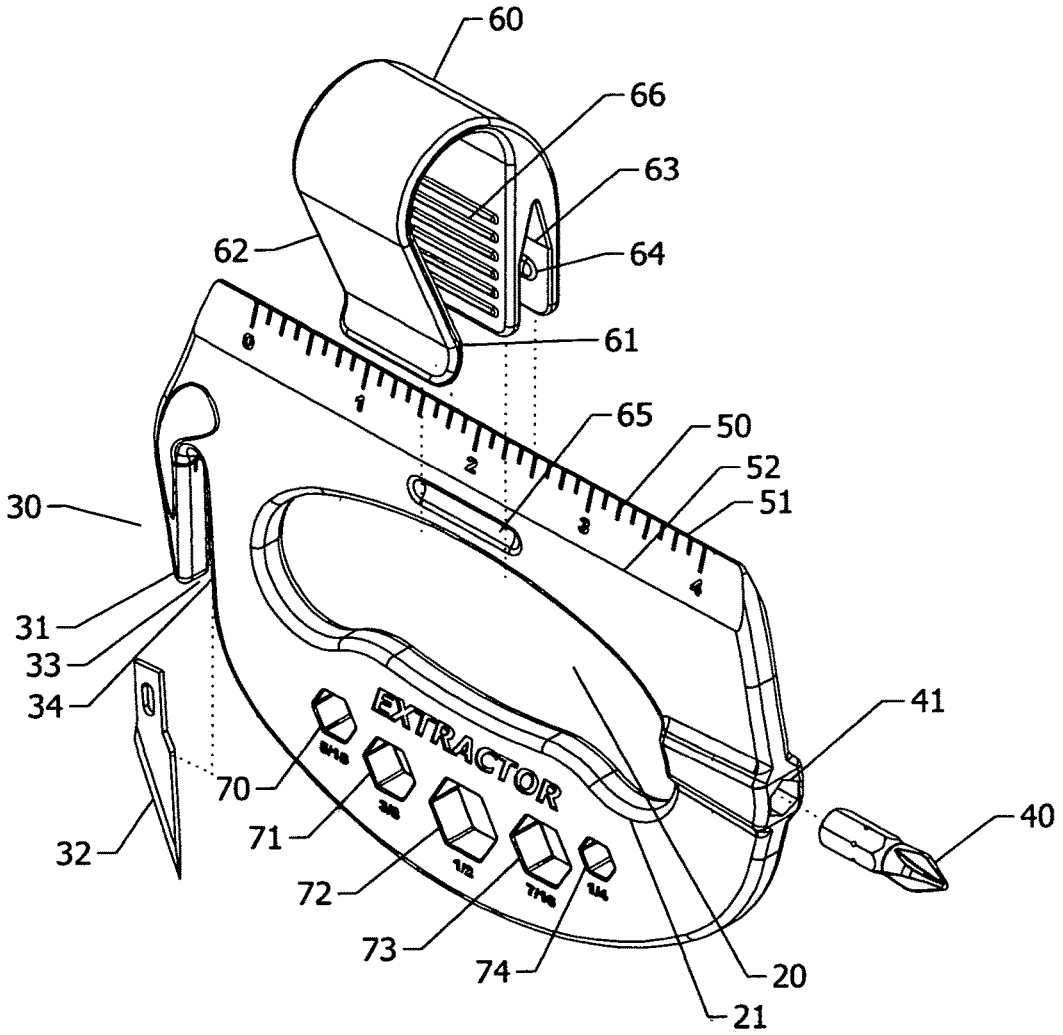
FIG. 4 discloses an exploded view of the multi-functional hand held emergency escape device.

FIG. 4 shows an exploded view of multi-functional emergency vehicle escape device (10). Device (10) incorporates an opening in the structure for one's hand to be inserted (20), an ergonomic hand grip (21) to enable one to efficiently grip device (10) and hold it firmly within one's hand, a seat belt cutter (30) located on the left side device (10), consisting of an exterior portion of the blade holder (31), a sharp blade (32), a blade slot (33) in which blade (32) is inserted, and an interior portion of bladed holder (34). On the right side of device (10) is the automotive window breaking apparatus consisting of a tungsten carbide tipped steel probe (40) that is designed to shatter automotive window glass with a single strike. During the manufacture of device (10), the tungsten carbide steel probe (40) is inserted into channel (41) located on the right side of device (10). Probe (40) is held in position by compression fitting. Channel (41) is drilled to be slightly smaller than the diameter of the tungsten carbide probe (40) and held securely in device (10). The top portion of the device (10) contains a ruler (50) containing a top edge (51) which can be used as a scraper to remove debris from the windshield. The bottom edge of ruler (50) protrudes a few millimeters from top edge (51) to help remove debris from device (10) while being used as a scraper by diverting the debris away from device (10). Slightly below the bottom edge of ruler (50) is an indentation or depression (53) in the body of device (10) to attach a removable clip (60). The interior surface of removable clip (60) has several elevated projections (66) to firmly hold device (10) in position on the window visor. Removable clip (60) consist of a proximal portion (61), a distal portion (62), a V-shaped slot (63), and interior projecting tab (64) to secure the removable clip (60) and a plurality of raised clip tabs (66) to secure removable clip (60) to a visor. Device (10) is also equipped with hex head fittings (70, 71, 72, 73, 74) ranging in a variety of sizes from 0.7942 to 1.27 cm. Device (10) can also be used as a tool to either secure or remove hex head bolts.

Figure 5:
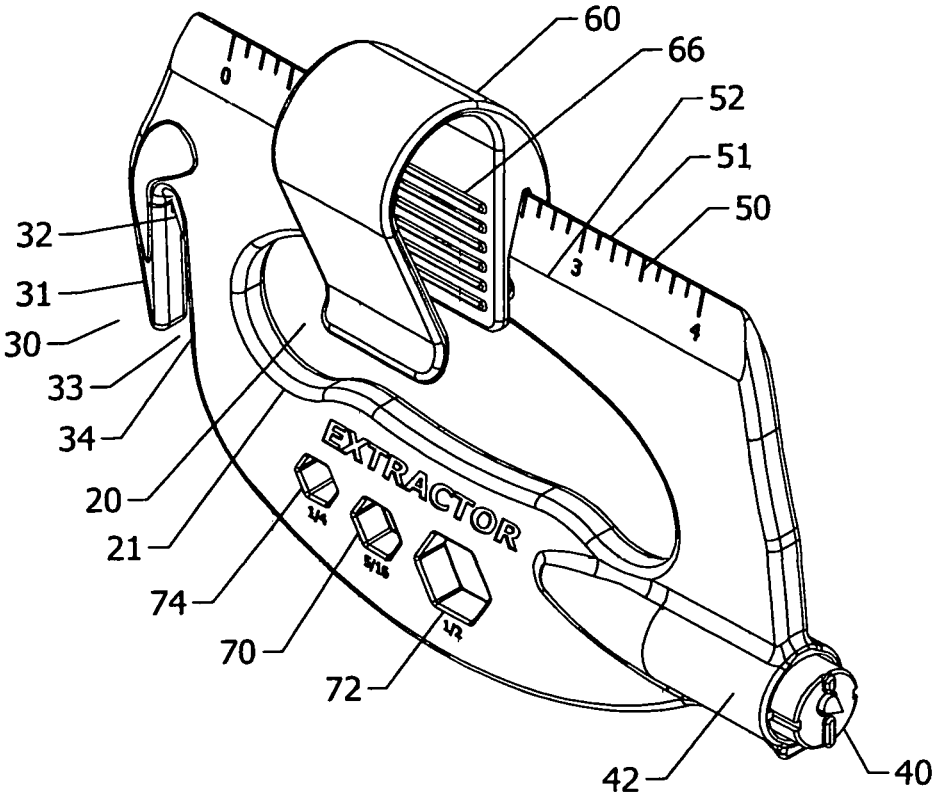
FIG. 5 discloses a perspective view of another embodiment of the multi-functional hand held emergency escape device equipped with a spring loaded tungsten carbide probe.

FIG. 5 illustrates a prospective view of a different embodiment of multi-functional emergency vehicle escape device (10) wherein a larger diameter tungsten carbide probe (40) is propelled against the window glass by a spring loaded mechanism (42) to shatter the window glass. Device (12) is made of a light weight, yet durable, ABS plastic that is injection molded to form an ergonomic designed hand held device. Device (12) is strong enough to withstand the forces typically encountered in emergency situations. It is very rigid and can withstand the pressures encountered in attempting to cut a seat belt or smash an automotive glass window. This also applies to windows that are coded with a window darkening substance or a coated film. The name of the emergency escape device is termed the Extractor (11) since its primary use is to escape from a damaged vehicle. Device (12) is designed to be hand held and incorporates an opening in the structure for one's hand to be inserted (20). The ergonomic hand grip (21) is designed to enable one to efficiently grip device (12) and hold it firmly within one's hand. Seat belt cutter (30) is located on the left side device (10) and consist of an exterior portion of the blade holder (31), a sharp blade (32), a blade slot (33) in which blade (32) is inserted, and an interior portion of bladed holder (34). On the right side of device (12) is the automotive window breaking apparatus consisting of a tungsten carbide tipped steel probe (40) that is designed to shatter automotive window glass with a single strike. This is primarily due to the use of a tungsten carbide steel tip which is at least made of at least 16% tungsten carbide. Tungsten carbide is considered one of the hardest metals available for commercial use. It is nearly as hard as diamond on the scale of hardness. The tungsten carbide content can be increased beyond 16% to enhance further the efficacy of the tungsten carbide probe (40). During the manufacture of device (12), the tungsten carbide steel probe (40) is inserted in a channel located on the right side of device (12). Probe (40) is held in place by compression fitting. Channel (41) not shown herein is drilled to be slightly smaller than the diameter of the tungsten carbide probe (40) and held securely in device (12). Probe (40) is held up against a closed window and is propelled by a spring loaded device (42). The top portion of the device (12) is a ruler (50) containing a top edge (51) which can be used as a scraper to remove debris from the windshield. It also be used as a scraper ice. The bottom edge of ruler (50) protrudes a few millimeters from top edge (51) to help remove debris from device (10). Slightly below bottom edge of ruler (50) is an indentation or depression (53) in the body of device (10) to attach a removable clip (60). Indentation (53) in a different embodiment can actually be a opening in which to receive removable clip (60). The interior surface of removable clip (60) has several elevated projections to firmly hold device (10) in position on the window visor. Device (12) is also equipped with hex head fittings (70, 72, and 74) ranging in a variety of sizes from 0.7942 to 1.27 cm. Device (12) can also be used as a tool to either secure or remove hex head bolts.

What is claimed:

1. A multi-functional vehicle escape device comprising:

a ergonomic designed hand held device made of rigid ABS plastic, a seat belt cutter to release a jammed or inoperative vehicle seat belt, a single strike tungsten carbide steel probe that contains at least 16% tungsten carbide, a single removable clip that enables the escape device to be conveniently located on a window visor, a ruler comprising a top surface and a bottom surface the top surface which serves as means to remove debris adhering to window glass in event of an accident, and a plurality of hex head fittings incorporated into the escape device to aid the motorist to remove hex head bolts to aid in escaping from the vehicle.

2. A multi-functional vehicle escape device of claim 1 wherein the escape device is made of a molded rigid composite material.

3. A multi-functional vehicle escape device of claim 1 wherein the seat belt cutter consists of an inverted V-shaped structure that has a sharp blade to cut the fabric of a seat belt with a single stroke.

4. A multi-functional vehicle escape device of claim 1 wherein the tungsten carbide steel probe is made with 16%-32% tungsten carbide.

5. A multi-functional vehicle escape device of claim 1 wherein the bottom of the ruler extends laterally further than the top surface of the ruler thus enabling debris adhering to the window glass to be easily removed.

6. A multi-functional vehicle escape device of claim 1 wherein there are six hex head fittings.

7. A alternate embodiment of a multi-functional vehicle escape device comprising:

a ergonomic designed hand held device made of rigid plastic, a seat belt cutter to release a jammed or inoperative vehicle seat belt, a single strike spring loaded tungsten carbide steel probe to shatter a vehicle window that is no longer functional due to damage incurred from an accident, a single strike tungsten carbide steel probe that contains at least 16% tungsten carbide, a single removable clip that enables the escape device to be conveniently located on a window visor, a ruler consisting of a top surface and a bottom surface, the top surface which serves as means to remove debris adhering to window glass in event of an accident, and a plurality of hex head fittings incorporated into the escape device to aid the motorist to remove hex head bolts.

8. A multi-functional vehicle escape device of claim 7 wherein the seat belt cutter comprises an inverted V-shaped structure that is equipped with a blade to cut a seat belt with a single stroke.

9. A multi-functional vehicle escape device of claim 8 wherein the tungsten carbide steel probe is made with 16%-32% tungsten carbide.

10. A multi-functional vehicle escape device of claim 8 wherein the removable clip enables the escape device to be easily stored in a glove compartment.

11. A multi-functional vehicle escape device of claim 8 wherein the bottom edge of the ruler extends laterally further than the top surface of the ruler thus enabling debris adhering to the window glass to be easily removed.

12. A multi-functional vehicle escape device of claim 8 wherein there are three hex head fittings to enable the vehicle occupant to remove a variety of different sized hex head bolts.

* * * * *